US008246363B2

(12) United States Patent
Lo

(10) Patent No.: US 8,246,363 B2
(45) Date of Patent: Aug. 21, 2012

(54) SAFETY SOCKET

(75) Inventor: Ding-Ea Lo, Taipei (TW)

(73) Assignee: Ding-Ea Lo, Taipei (TW)

( * ) Notice: Subject to any disclaimer, the term of this patent is extended or adjusted under 35 U.S.C. 154(b) by 183 days.

(21) Appl. No.: 12/859,135

(22) Filed: Aug. 18, 2010

(65) Prior Publication Data

US 2012/0045921 A1 Feb. 23, 2012

(51) Int. Cl.
*H01R 13/44* (2006.01)

(52) U.S. Cl. ..... 439/134

(58) Field of Classification Search ..... 439/134, 439/133

See application file for complete search history.

(56) References Cited

U.S. PATENT DOCUMENTS 3,543,544 A * 12/1970 Efston ..... 439/134
4,494,809 A * 1/1985 Soloman ..... 439/369
4,566,297 A * 1/1986 Hawley ..... 70/57
4,640,107 A * 2/1987 Slade ..... 70/57
5,171,155 A * 12/1992 Mendoza ..... 439/134

* cited by examiner

*Primary Examiner* — Phuong Dinh
(74) *Attorney, Agent, or Firm* — Apex Juris, pllc; Tracy M. Heims

(57) ABSTRACT

A safety socket has an insertion block, a base and a conducting unit. The insertion block has an inner housing and two support frames mounted in the inner housing. The base has an outer housing covered on the inner housing and two guide arms mounted in the outer housing. The conducting unit is mounted between the support arms and between the guide arms. When two blades of a plug are plugged in the insertion block and pushed inwardly, the conducting unit is rotated to electrically connect with the two blades. Each one of the guide arms and the two blades is held between the conducting unit and the corresponding support arm to keep the plug from being unplugged arbitrarily. When the insertion block is pushed again, the conducting unit is rotated and the plug can be easily unplugged.

16 Claims, 18 Drawing Sheets

SAFETY SOCKET

BACKGROUND OF THE INVENTION

1. Field of the Invention

The present invention relates to a safety socket, and more particularly to a power socket being anti-loose when a plug is engaged therewith and being easy-unplugging when the plug is disengaged therewith.

2. Description of the Related Art

To electrically connect an electrical appliance to a power socket, a power plug is inserted into the power socket and blades of the power plug are held by conductive strips of the power sockets. The power socket holds the power plug firmly when the power socket is in a new condition, so to detach the plug from the power socket requires one hand holding the plug and the other hand pushing against the power socket and such a procedure is inconvenient. Furthermore, the holding force of the conductive strips will gradually reduce after a term of use, and the power plug becomes easily removable even by a slight touch. So it increases both electrocution and fire risks and endangers young children.

To improve safety, locking means have been used to secure the plug with the power socket. The conventional locking means comprises screws to connect the power plug and socket. However, the screws must then be unscrewed before removing the plug from the power socket, which is both time-consuming and laborious. Therefore, an easy-to-unplug locking means is needed.

SUMMARY OF THE INVENTION

The objective of the present invention is to provide a safety socket being anti-loose when a plug is engaged therewith and being easy-unplugging when the plug is disengaged therewith.

To achieve the foregoing objective, the safety socket has at least one insertion block, a base and at least one conducting unit.

Each one of the at least one insertion block has an inner housing and two support frames. The inner housing is hollow and has a bottom wall, a front wall, two sidewalls, an opening, two insertion holes and at least one protrusion. The opening is formed through the bottom wall. The two insertion holes are formed through the front wall. Each one of the at least one protrusion is formed on and protrudes from an outside surface of the sidewall adjacent to the front wall. The two support frames are securely mounted in the inner housing. Each support frame has a fence securely mounted in the inner housing.

The base has an outer housing and at least one pair of guide arms. The outer housing is hollow and covered on the at least one insertion block, and has a top wall, a rear wall, two sidewalls, an opening and at least one slot.

The opening is formed through the top wall and faces the opening of each one of the at least one inner housing. Each one of the at least one slot is formed through one of the sidewalls to receive a corresponding protrusion. Each pair of the guide arms is securely mounted on an inside surface of the rear wall to respectively guide the two support frames on a corresponding insertion block.

Each one of the at least one conducting unit is mounted between the two support frames and has ratchet wheel, a pawl, a driving assembly and an electrical connection assembly. The ratchet wheel has a center hole and multiple teeth. The center hole is formed through the ratchet wheel. The teeth are formed on a rim of the ratchet wheel. One end of the pawl is pivotally connected to an inside surface of the front wall of a corresponding inner housing. The other end abuts against one of the teeth of the ratchet wheel. The driving assembly has a disk, a support arm and a locating link. The disk has multiple locating recesses and a center hole. The locating recesses are circumferentially formed in a bottom of the disk. The center hole is formed through the disk. One end of the support arm is securely mounted on the inside surface of the rear wall of the outer housing. The locating link is pivotally mounted on the other end of the support arm and has a locating protrusions and a center hole. The locating protrusion selectively engages one of the locating recesses of the disk. The center hole is formed through the locating link. The electrical connection assembly is mounted between the ratchet wheel and the driving assembly and has a carrier and multiple conducting rods. The carrier has a form of a solid cylinder and is mounted between the corresponding pair of guide arms of the base, and has multiple longitudinal grooves and a spindle. The longitudinal grooves are formed in the carrier. The spindle is formed through the carrier and is respectively mounted through the center holes of the ratchet wheel, the disk and the locating link. The conducting rods are respectively mounted in the longitudinal grooves. Two ends of each conducting rod are securely and respectively connected with the ratchet wheel and the disk.

The safety socket of the present invention is advantageous in that when two blades of a plug are respectively plugged in the two insertion holes of the insertion block and the inner housing is pushed inwardly, the locating link of the conducting unit is rotated an angle counterclockwise with respect to one end of the support arm. The disk is also rotated an angle counterclockwise by engaging the locating protrusion of the disk with a corresponding locating recess of the disk. The carrier of the electrical connection assembly is also rotated. After the carrier is rotated an angle counterclockwise, two conducting rods of the electrical connection assembly are electrically connected with the corresponding blades and the guide arms. When each one of the two blades is held by the corresponding fence and conducting rod, the plug cannot be easily unplugged from the safety socket.

When the inner housing is pushed inwardly again, the locating link of the driving assembly of the conducting unit is rotated an angle counterclockwise again and the electrical assembly is also rotated. The two conducting rods originally contacting the two blades of the plug are disengaged from the corresponding blades due to the rotation. In other words, the two blades are no longer held by the corresponding fences and conducting rods. Accordingly, the plug can be easily unplugged from the safety socket, thereby improving safety and user convenience, while making the socket anti-loose and easy-unplugging.

Other objectives, advantages and novel features of the invention will be explained in detail in the following description, together with the accompanying drawings.

DETAILED DESCRIPTION OF THE INVENTION

Figure 1:
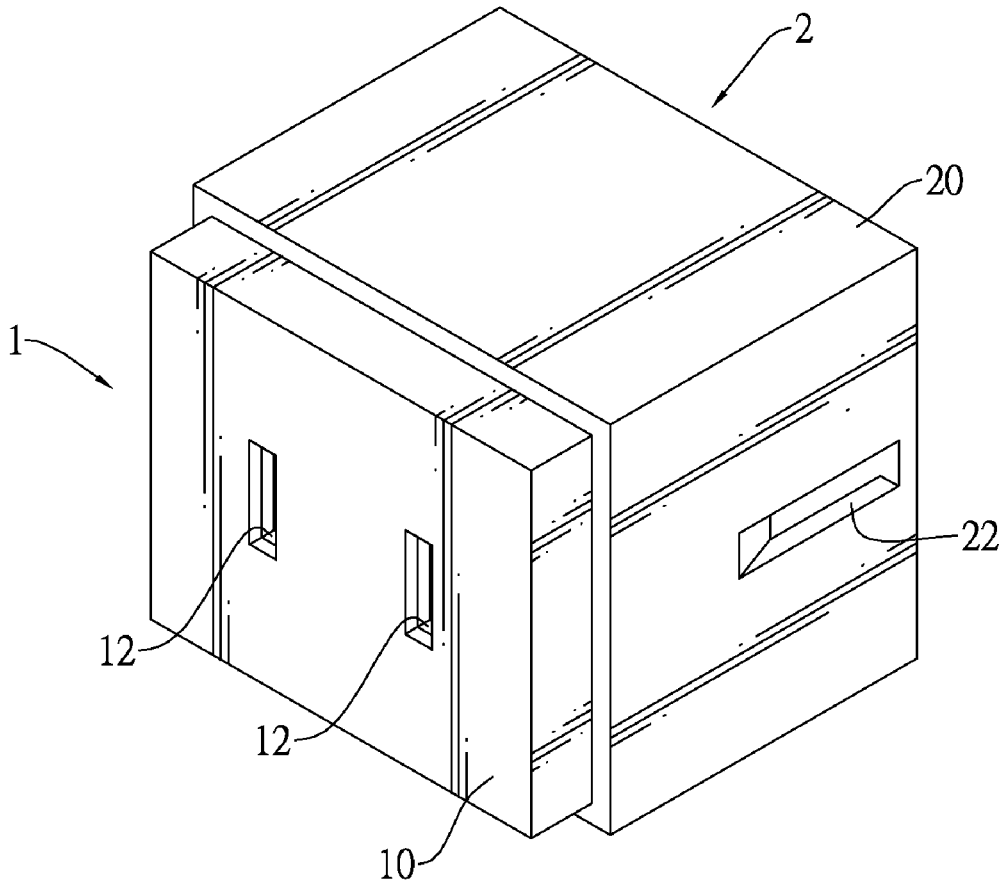
FIG. 1 is a perspective view of a first embodiment of a safety socket in accordance with the present invention.
Figure 2:
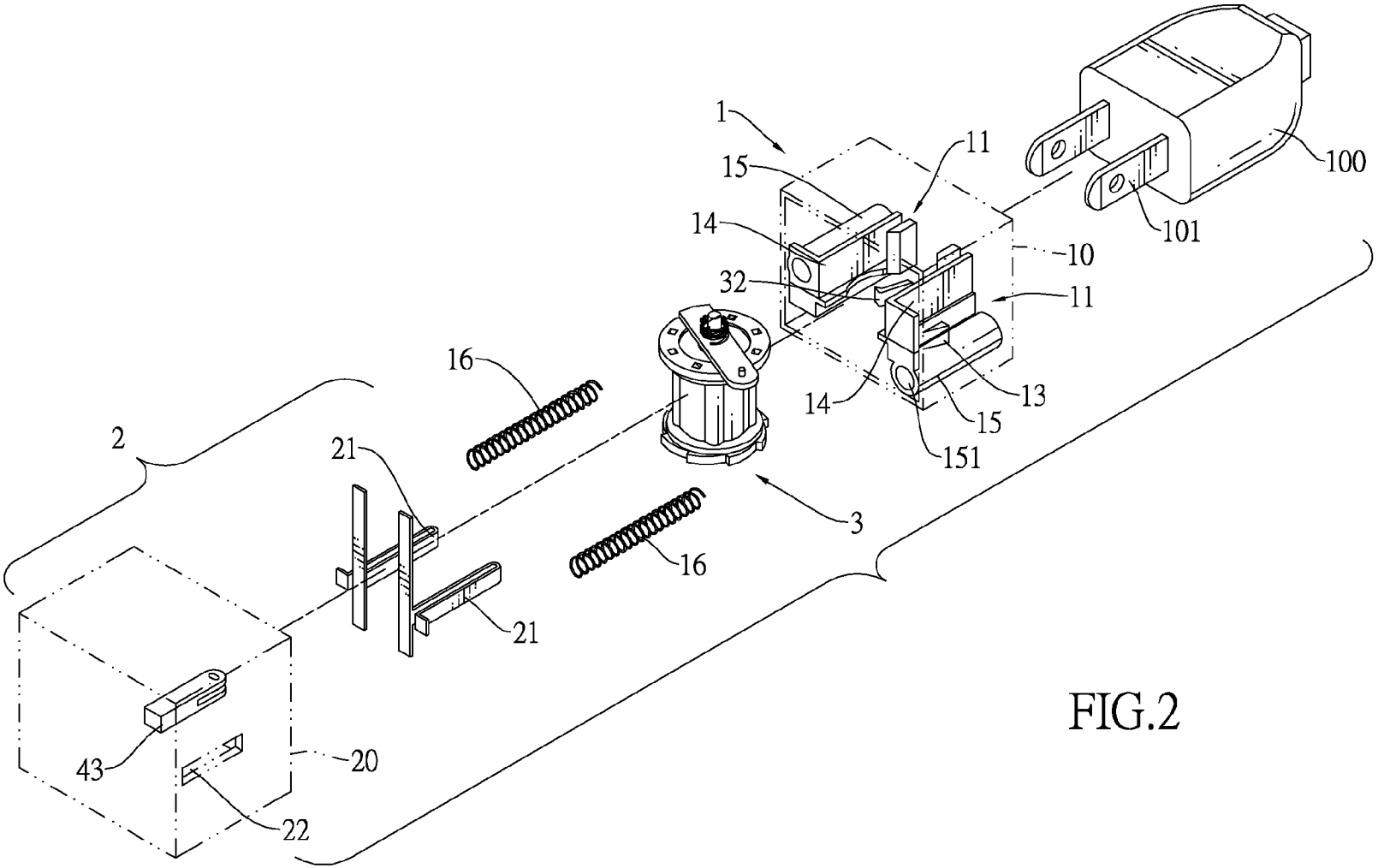
FIG. 2 is an exploded perspective view of the safety socket in FIG. 1.

With reference to FIGS. 1 and 2, a first embodiment of a safety socket in accordance with the present invention has at least one insertion block 1, a base 2 and at least one conducting unit 3. In the first embodiment, one insertion block 1 and one conducting unit 3 are shown.

The insertion block 1 has an inner housing 10 and two support frames 11. The inner housing 10 is cubical and hollow and has a bottom wall, a front wall, two sidewalls, an opening, two insertion holes 12 and at least one protrusion 13. The opening is formed through the bottom wall of the inner housing 10. The two insertion holes 12 are formed through the front wall of the inner housing 10. Each one of the at least one protrusion 13 is formed on and protrudes from an outside surface of one of the sidewalls of the inner housing 10 adjacent to the front wall. The two support frames 11 are securely mounted in the inner housing 10 and each one of the support frames 11 has a fence 14, a cylinder 15 and a resilient member 16. The fence 14 is securely mounted in the inner housing 10 and is adjacent to a corresponding insertion hole 12. The cylinder 15 is formed on a side of the fence 14 and one end of the cylinder 15 is securely mounted on an inside surface of the front wall of the inner housing 10. The cylinder 15 has a hole 151 formed through the cylinder 15. The resilient member 16 is received in the hole of the cylinder 15 and may be a spring. The base 2 has an outer housing 20 and two guide arms 21. The outer housing 20 is cubical and hollow, and has a top wall, a rear wall, two sidewalls and an opening. The opening is formed through the top wall of the outer housing 20. The outer housing 20 is covered on the insertion block 1 and the opening of the outer housing 20 faces that of the inner housing 10. The outer housing 20 further has at least one slot 22. Each one of the at least one slot 22 is formed through one of the sidewalls of the outer housing 20 to receive a corresponding protrusion 13 and guide the protrusion 13 to move therein. Each one of the two guide arms 21 is securely mounted on an inside surface of the rear wall of the outer housing 20 to guide a corresponding support frame 11.

Figure 3:
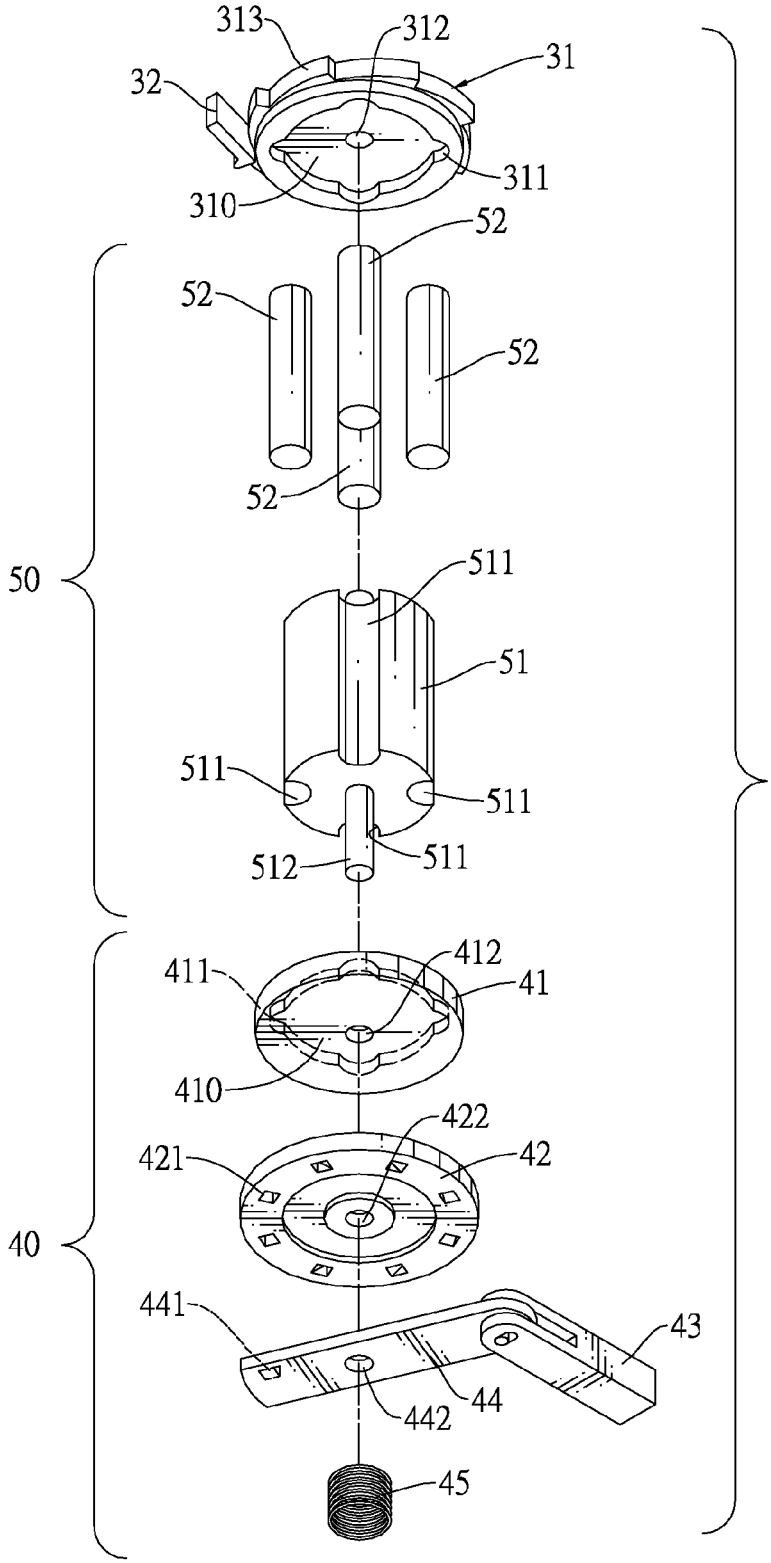
FIG. 3 is an exploded perspective view of a conducting unit of the safety socket in FIG. 1.
Figure 4:
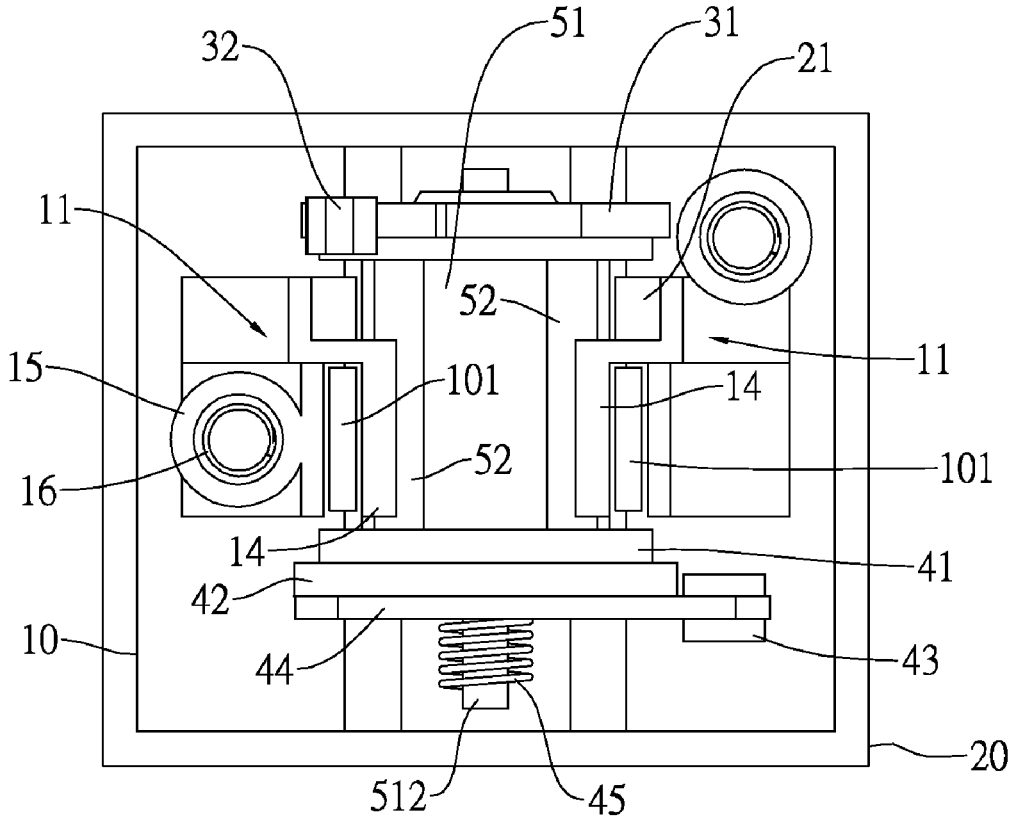
FIG. 4 is a front view in partial section of the safety socket in FIG. 1.

With reference to FIGS. 2 to 4, the conducting unit 3 is mounted between and held by the two support frames 11 of the insertion block 1 and has a ratchet wheel 31, a pawl 32, a driving assembly 40, an electrical connection assembly 50. The ratchet wheel 31 has a bottom recess 310, a center hole 312 and multiple teeth 313. The bottom recess 310 is formed in the bottom of the ratchet wheel 31 and has four bottom arced cavities 311 formed in a wall of the bottom recess 310. The center hole 312 is formed through the ratchet wheel 31. The teeth 313 are formed around a rim of the ratchet wheel 31. One end of the pawl 32 is connected to an inside surface of the front wall of the inner housing 10, and the other end engages one of the teeth 313 formed on the ratchet wheel 31 so that the ratchet wheel 31 can rotate in an unidirectional manner.

The driving assembly 40 has a cover 41, a disk 42, a support arm 43 and a locating link 44. The cover 41 has a top recess 410 and a center hole 412. The top recess 410 is formed in a top thereof and has four top arced cavities 411 formed in a wall of the top recess 410. The center hole 412 is formed through the cover 41. A top of the disk 42 is securely mounted on a bottom of the cover 41. The disk 42 has eight locating recesses 421 and a center hole 422. The locating recesses 421 are circumferentially and evenly formed in a bottom of the disk 42 with respect to the center hole 422 and an angle included between adjacent locating recesses 421 is 45°. The center hole 422 is formed through the disk 42. One end of the support arm 43 is securely mounted on the inside surface of the rear wall of the outer housing 20. The locating link 44 is pivotally connected to one end of the support arm 43 and has a locating protrusion 441 and a center hole 442. The locating protrusion 441 selectively engages one of the locating recesses 421. The center hole is formed through the locating link 44. The electrical connection assembly 50 is mounted between the ratchet wheel 31 and the cover 41 and has a carrier 51 and four conducting rods 52. The carrier 51 has a form of a solid cylinder, is mounted between the two guide arms 21 of the base 2 and has four longitudinal grooves 511 and a spindle 512. The four longitudinal grooves 511 are formed in the carrier 51. The spindle 512 is mounted through the center holes 312, 412, 422 and 442 of the ratchet wheel 31, the cover 41, the disk 42 and the locating link 44 respectively. Each one of the four conducting rods 52 is mounted in a corresponding longitudinal groove 511. One end of each one of the conducting rods 52 is fitted in a corresponding bottom arced cavity 311 of the ratchet wheel 31 and the other end is fitted in a corresponding top arced cavity 411 of the cover 41. The driving assembly 40 further has a resilient element 45 mounted around one end of the spindle 512 of the carrier 51 and compressing a bottom of the locating link 44 to abut against the disk 42.

Figure 5:
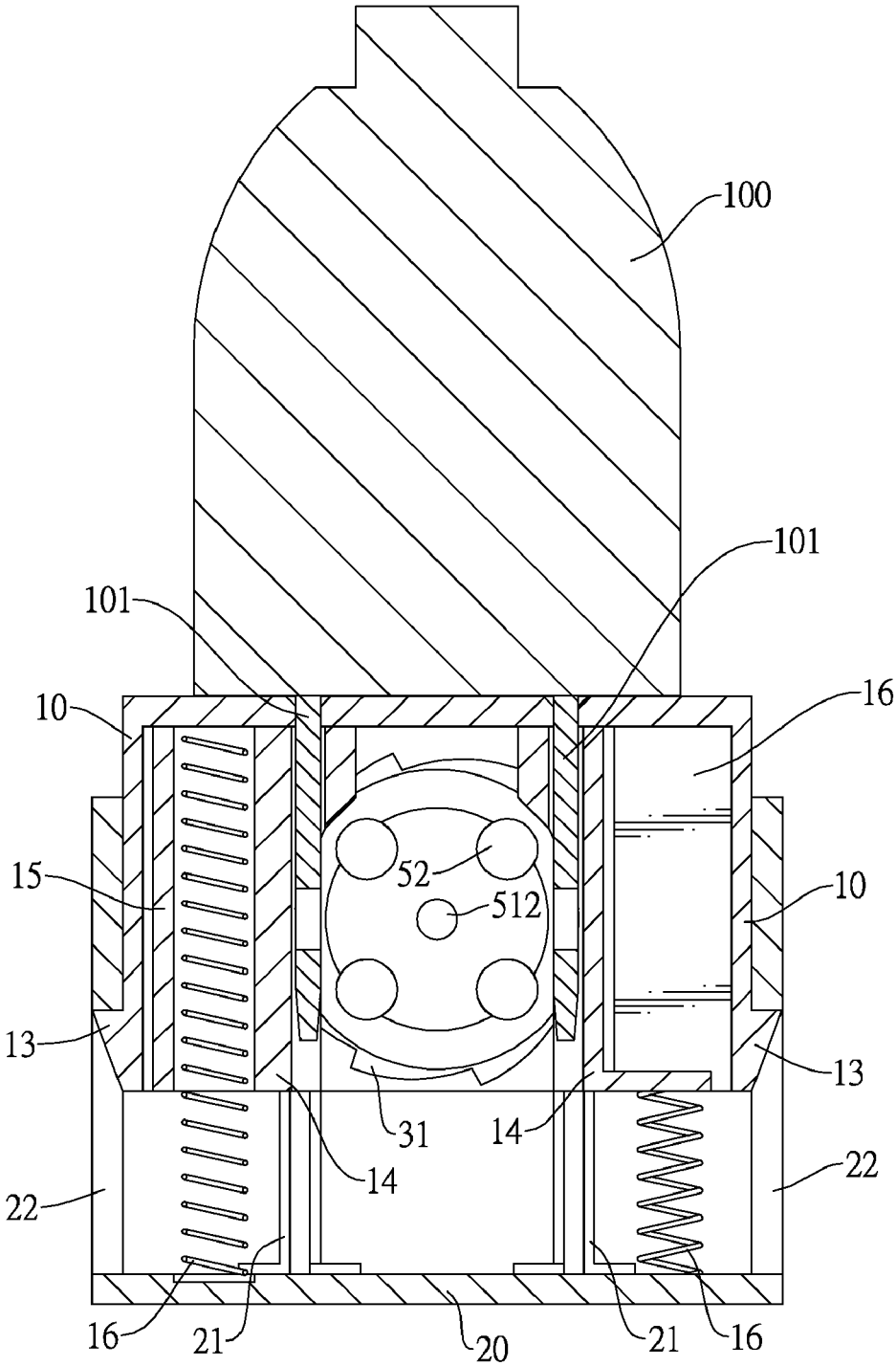
FIG. 5 is a top view in partial section of the safety socket in FIG. 1 when being plugged in by a power plug.
Figure 6:
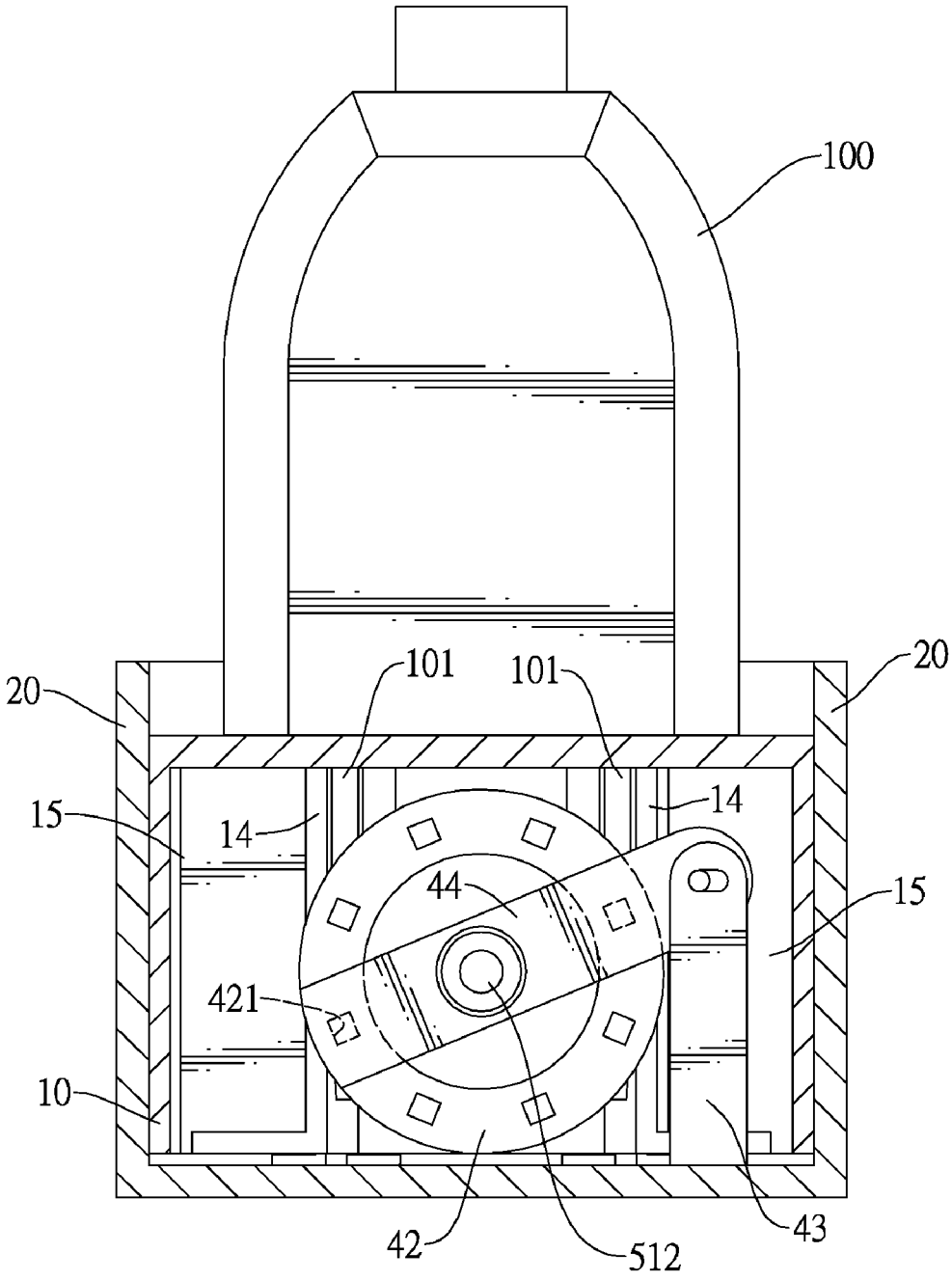
FIG. 6 is another top view in partial section of the safety socket in FIG. 1 when being plugged in by a power plug.
Figure 7:
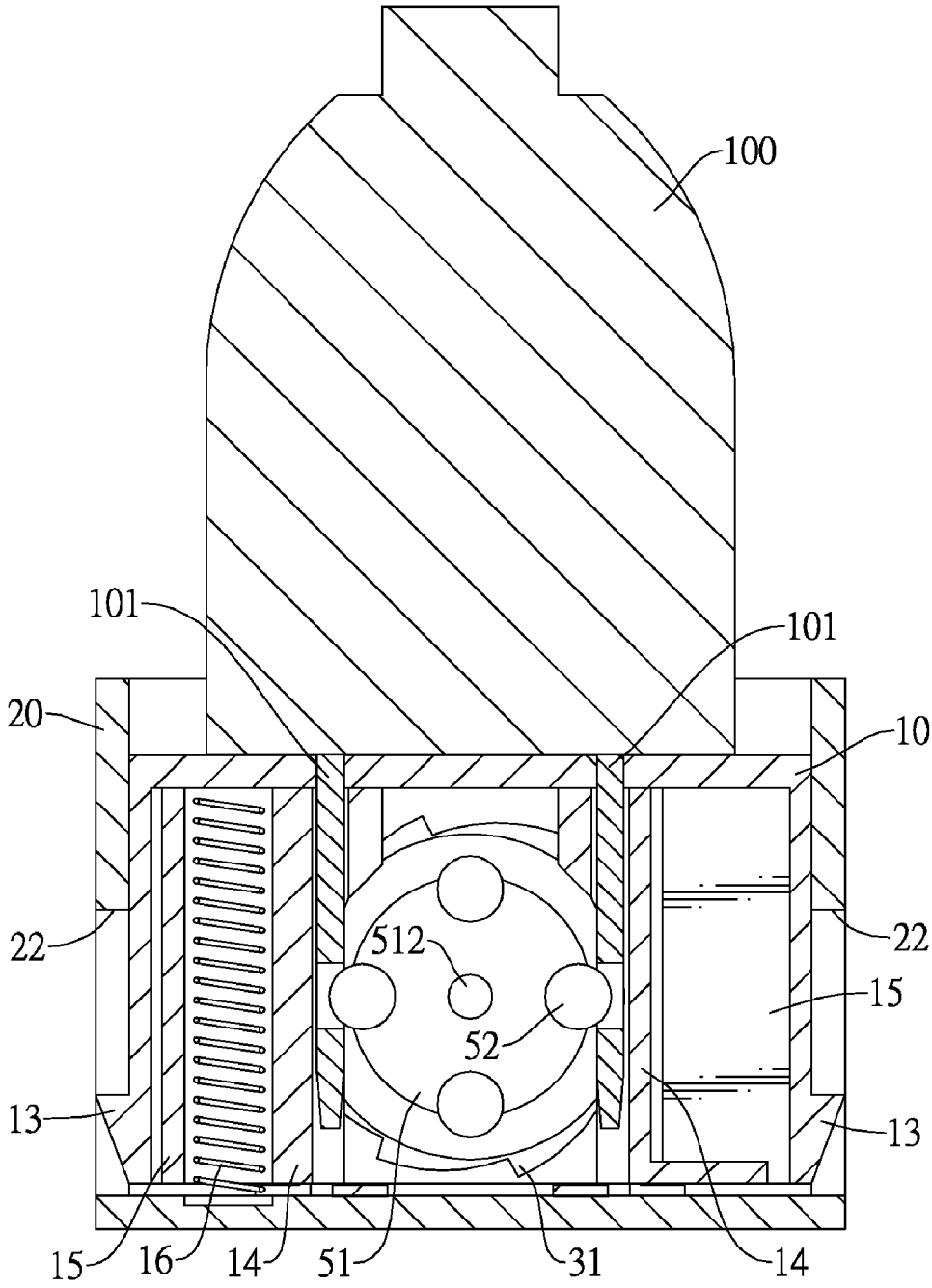
FIG. 7 is another top view in partial section of the safety socket in FIG. 1 when being plugged in by a power plug.
Figure 8:
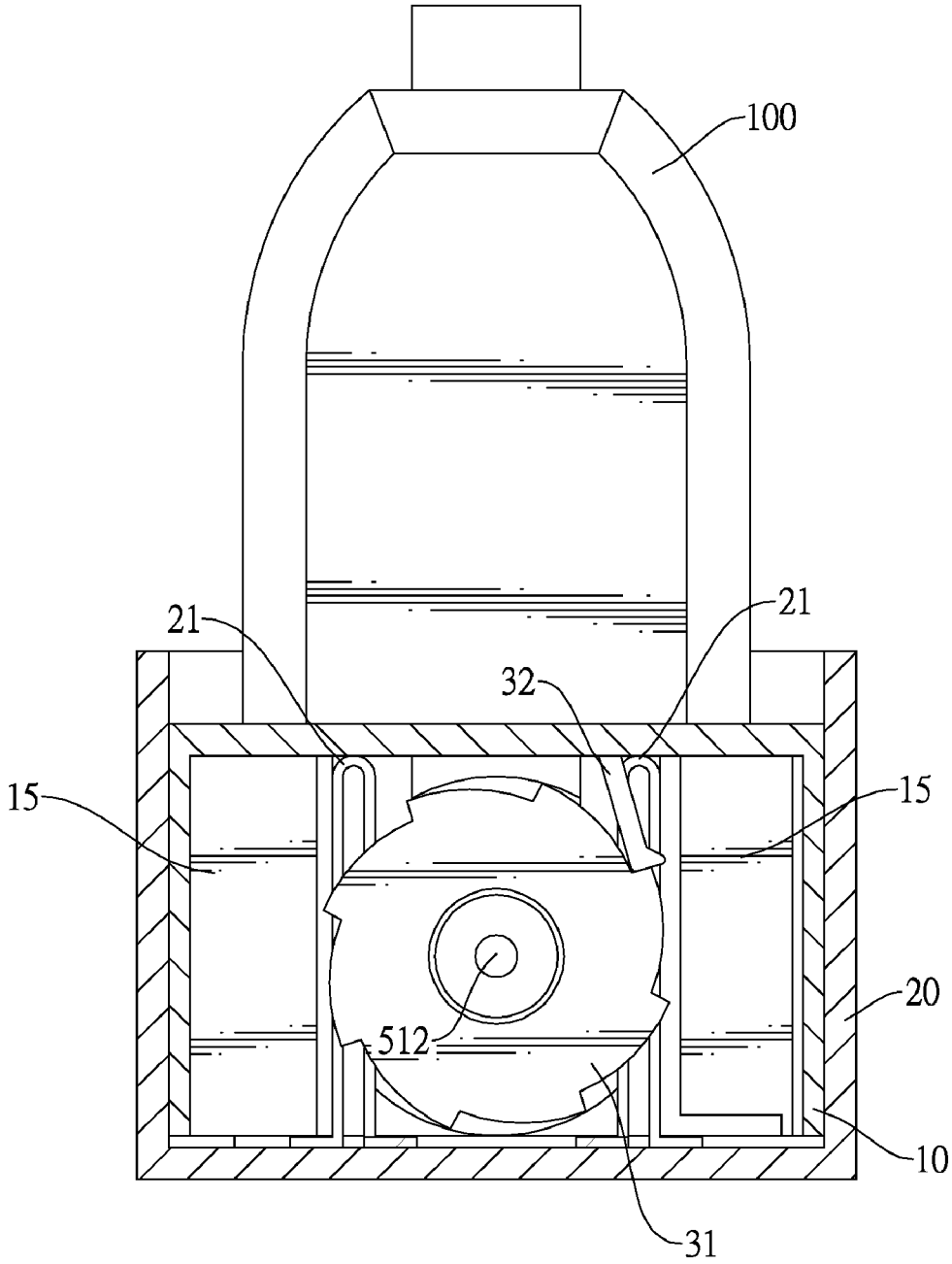
FIG. 8 is a bottom view in partial section of the safety socket in FIG. 1 when being plugged in by a power plug.
Figure 9:
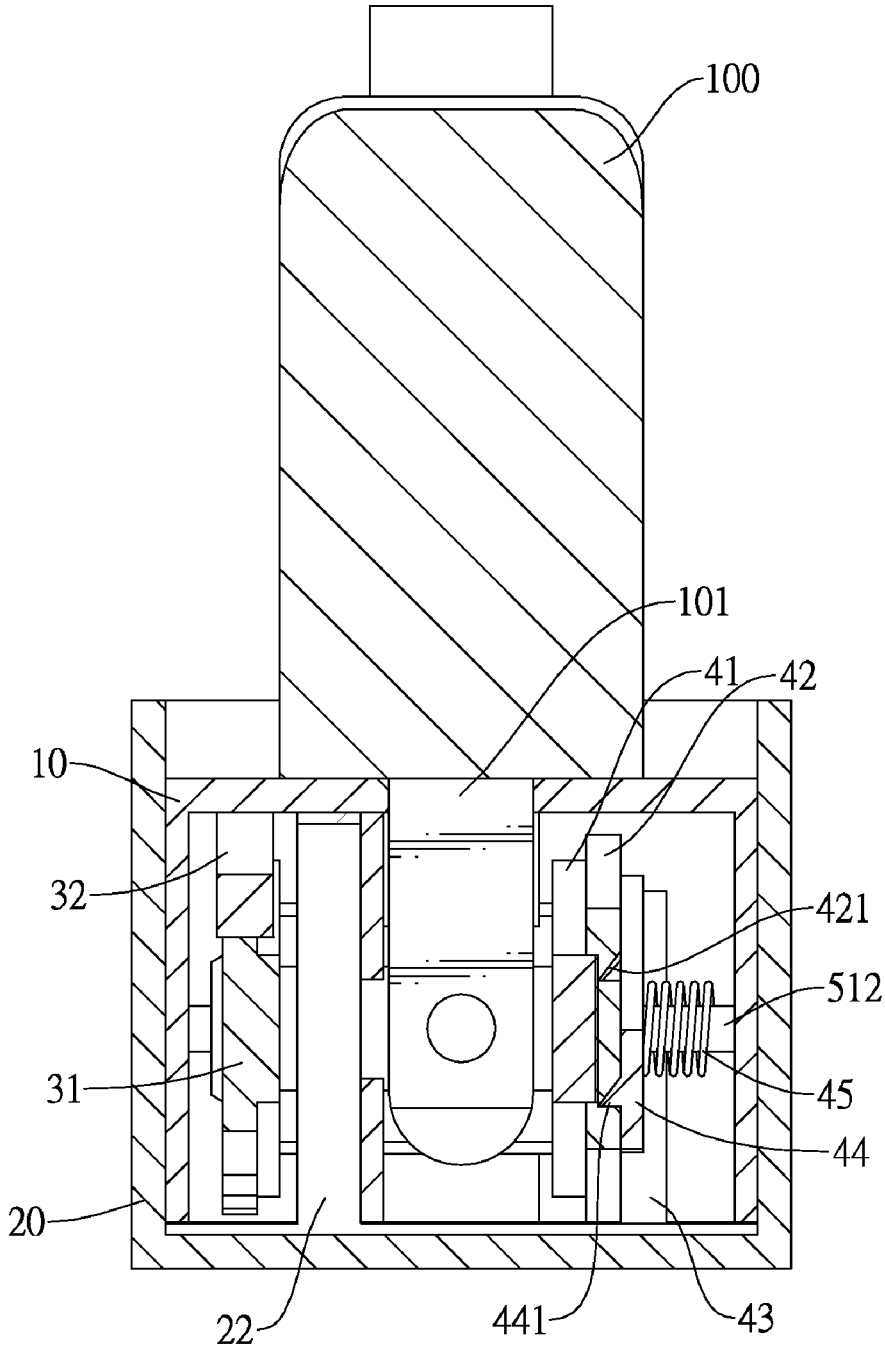
FIG. 9 is a side view in partial section of the safety socket in FIG. 1 when being plugged in by a power plug.

With reference to FIG. 5, when two blades 101 of a plug 100 are respectively plugged in the two insertion holes 12 of the insertion block 1 and the inner housing 10 is not pushed inwardly yet, the four conducting rods 52 of the conducting unit 3 are not contacted with any one of the blades 101 of the plug 100. At the moment, the plug 100 does not establish any electrical connection with the safety socket of the present invention.

With reference to FIGS. 6 to 10, when the inner housing 10 is pushed inwardly, and the locating link 44 of the conducting unit 3 is rotated 45° counterclockwise with respect to the pivoting end of the support arm 43. The locating protrusion 441 of the locating link 44 engages one of the locating recesses and the disk 42 is driven by the locating link 44 to rotate 45° counterclockwise. Because the disk 24 is securely mounted on the bottom of the cover 41 and the conducting rods 52 of the conducting unit 50 respectively engage the bottom arced cavities 311 of the ratchet wheel 31 and the top arced cavities 411 of the cover 41, the ratchet wheel 31, the cover 41 and the carrier 51 of the electrical connection assembly 50 are also rotated along with the disk 42.

Figure 10:
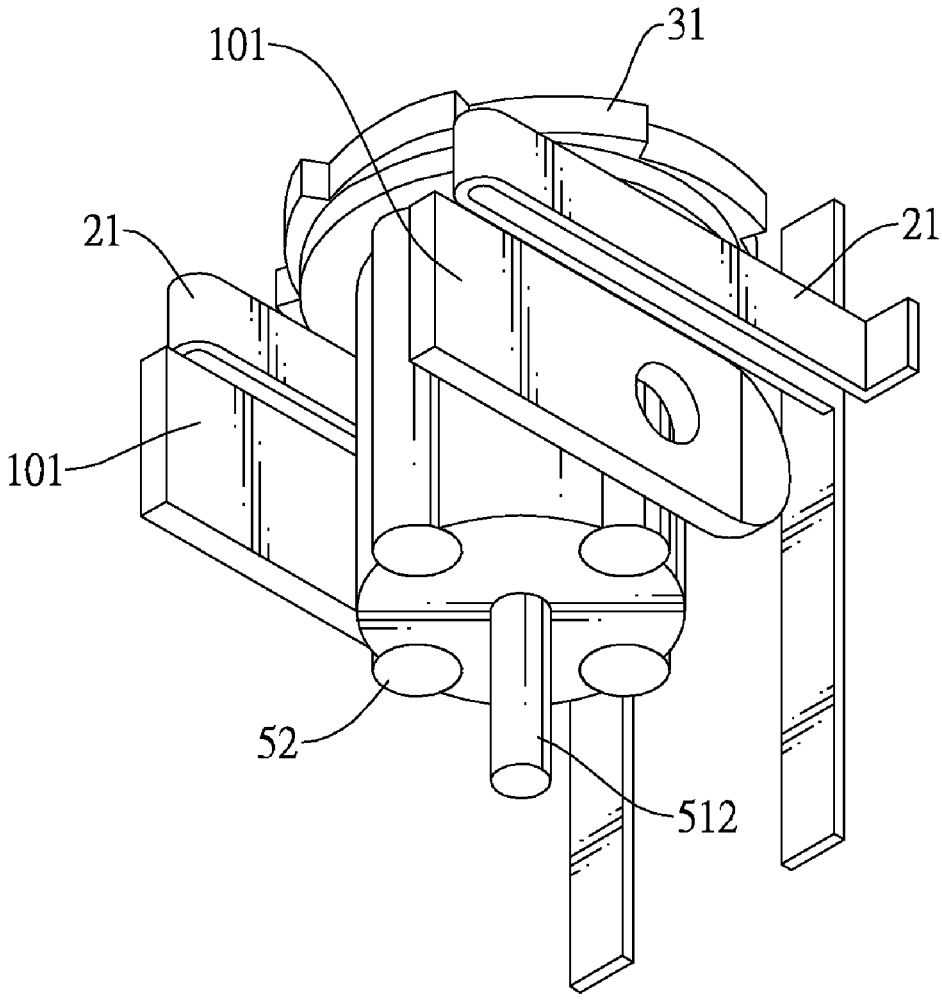
FIG. 10 is a partial perspective view of the safety plug in FIG. 1 when being plugged in by two blades of a power plug.
Figure 11:
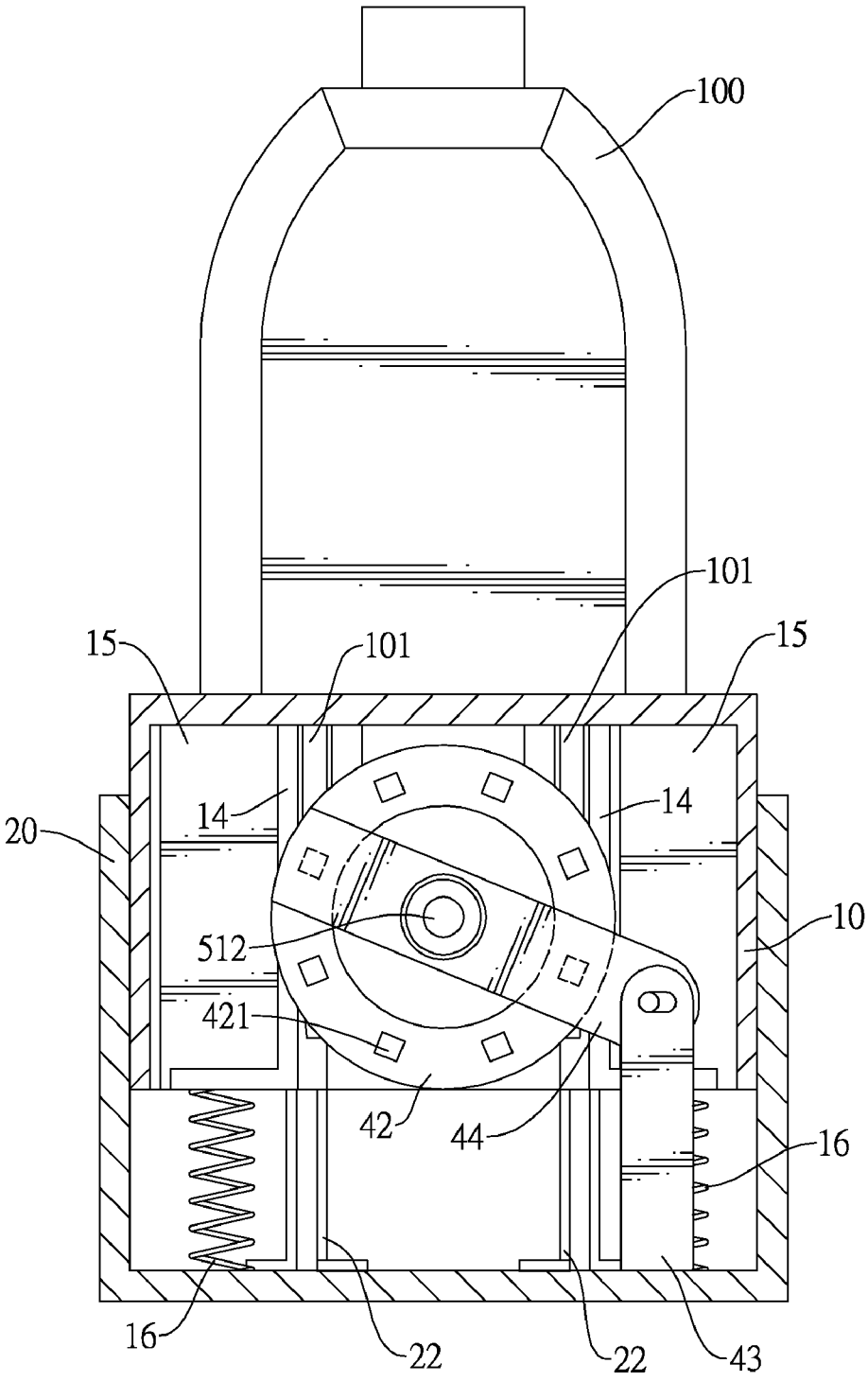
FIG. 11 is another top view in partial section of the safety socket in FIG. 1 when being plugged in by a power plug.

With reference to FIG. 10, after the carrier 51 is rotated counterclockwise 45°, two conducting rods 52 of the electrical connection assembly 50 respectively contact with the corresponding blades 101 of the plug 100 and the two blades 101 simultaneously contact with the corresponding guide arms 21 to establish the electrical connection path through the guide arms 21 and the conducting rods 52 to the blades 101.

Figure 12:
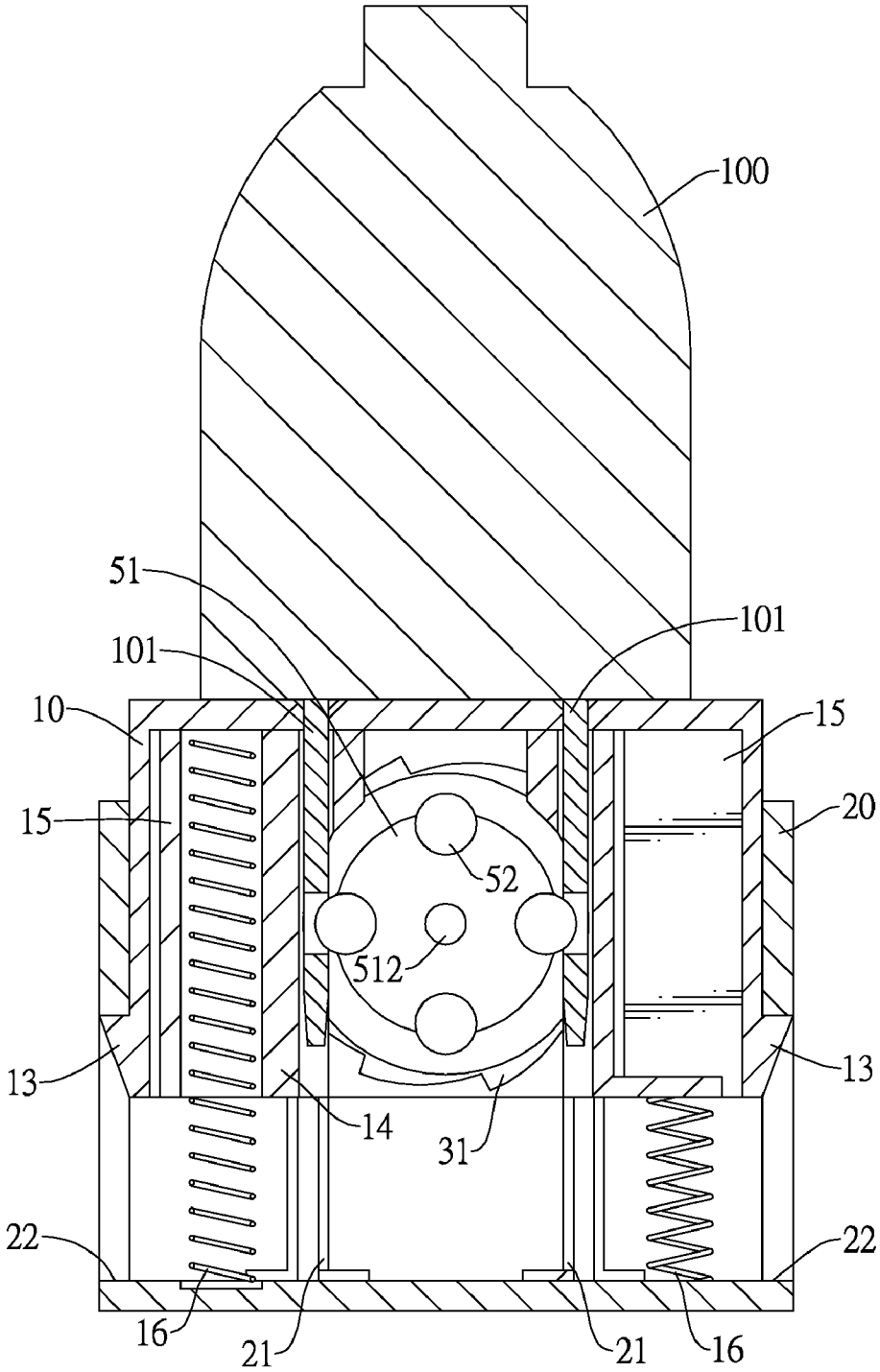
FIG. 12 is another top view in partial section of the safety socket in FIG. 1 when being plugged in by a power plug.
Figure 13:
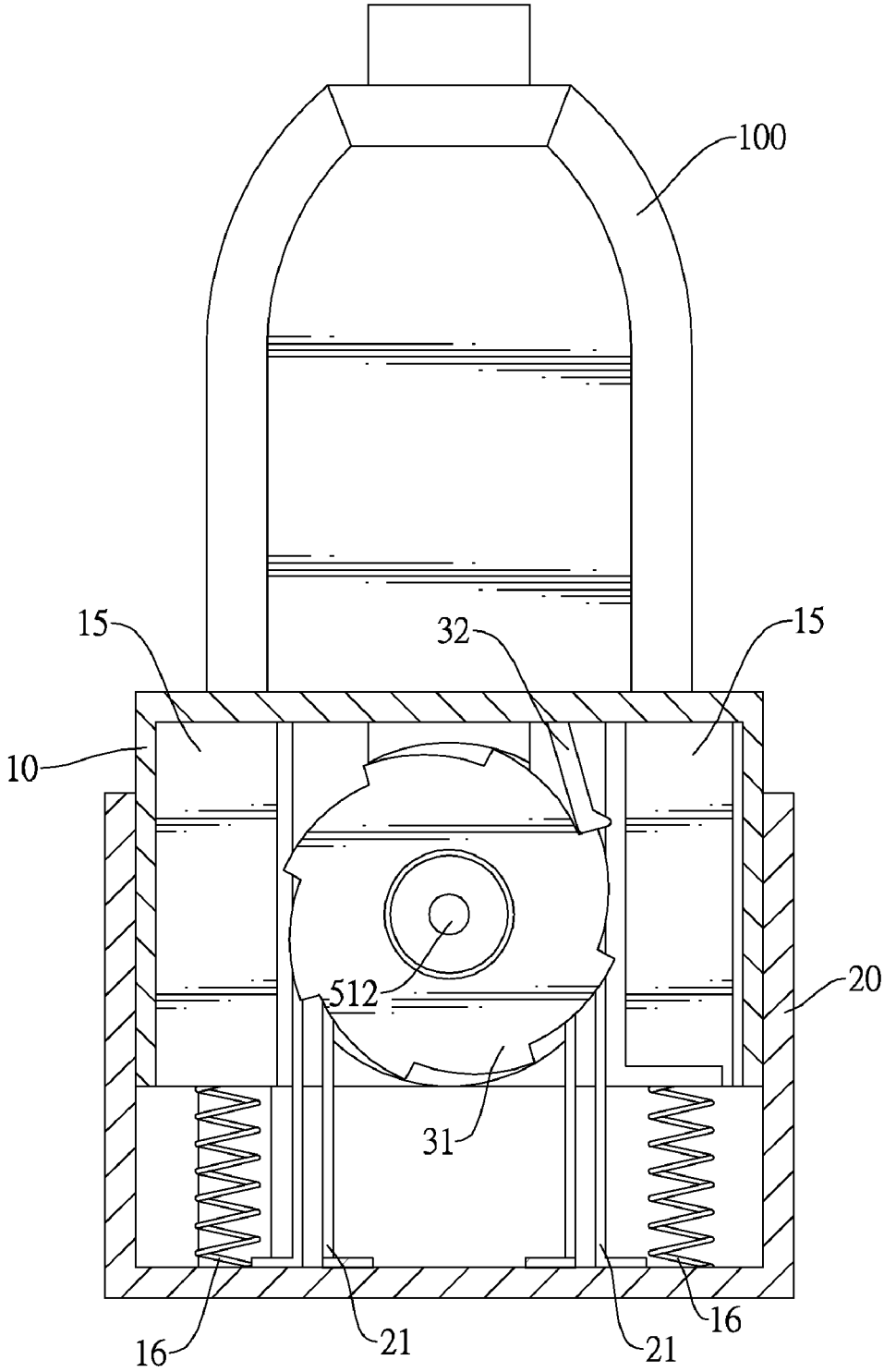
FIG. 13 is another bottom view in partial section of the safety socket in FIG. 1 when being plugged by a power plug.
Figure 14:
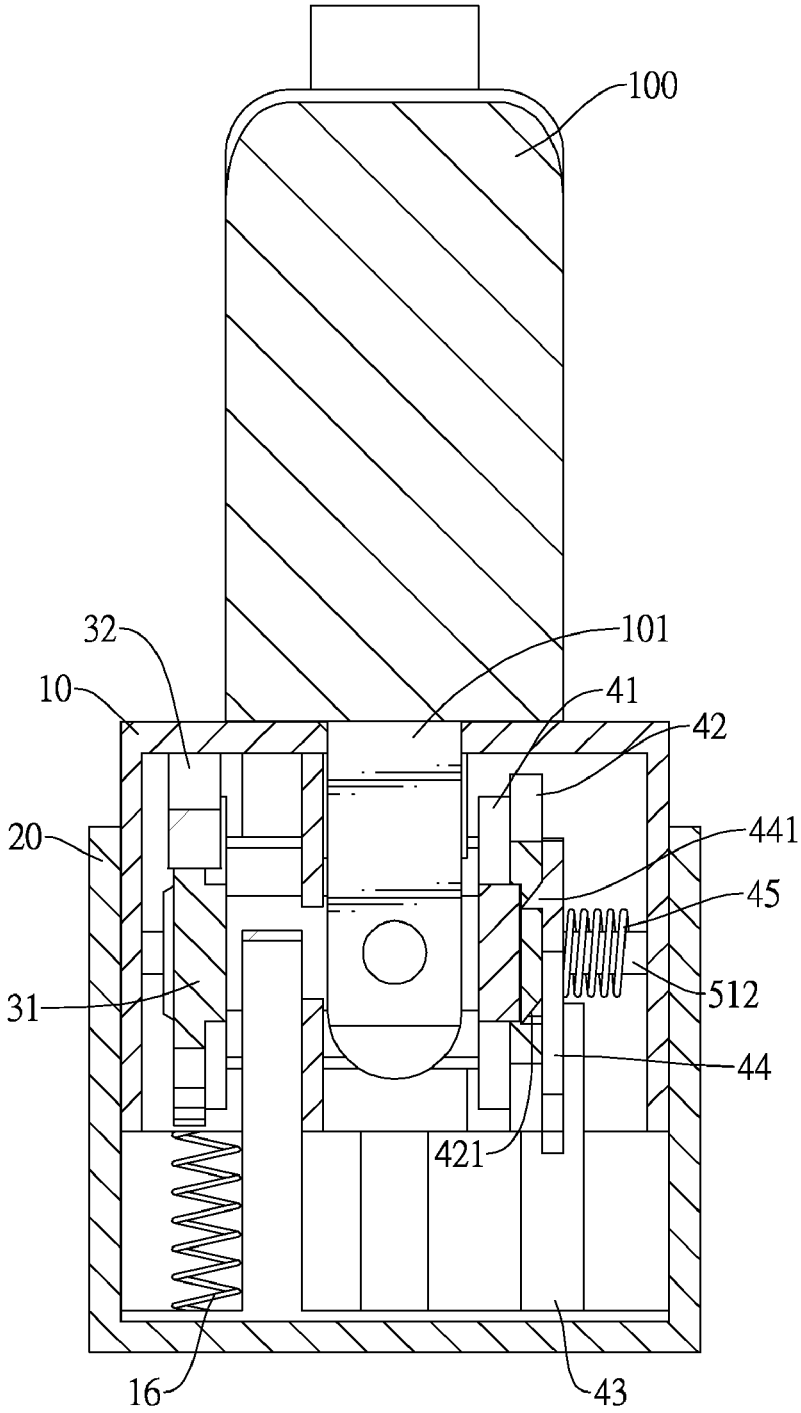
FIG. 14 is another side view in partial section of the safety socket in FIG. 1 when being plugged by a power plug.
Figure 15:
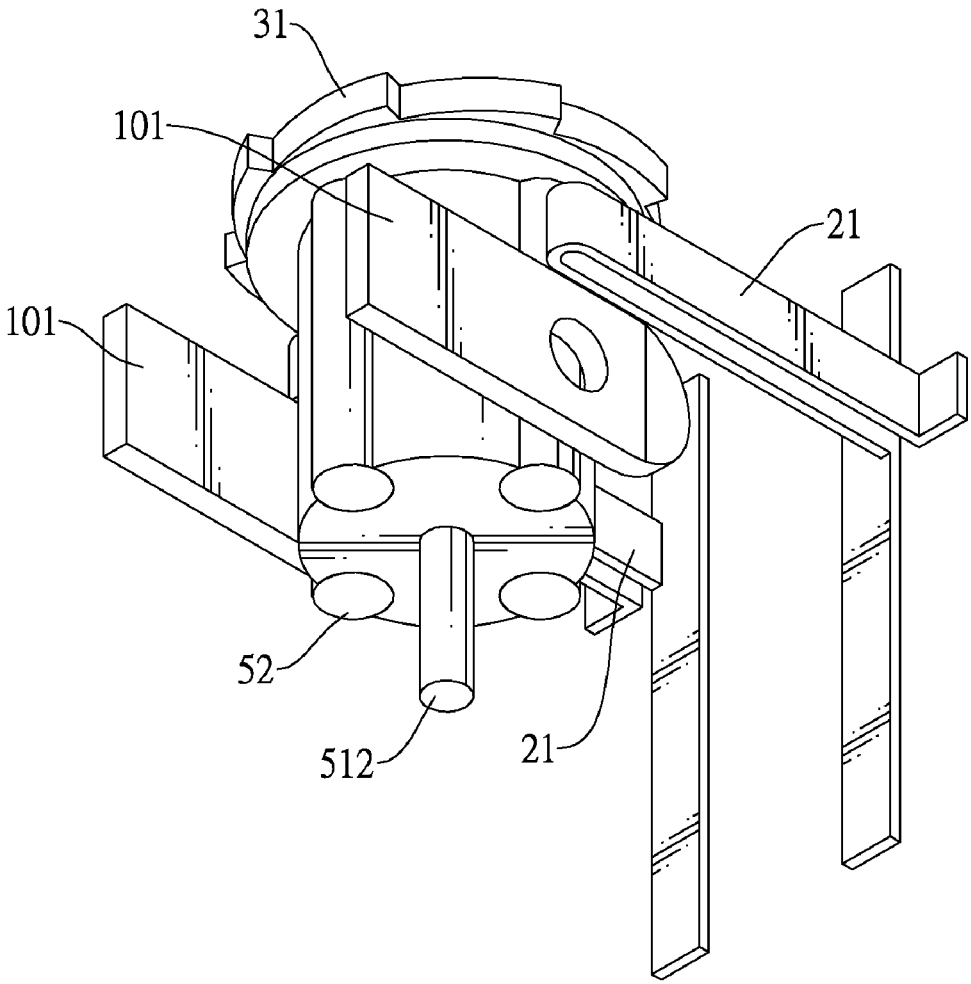
FIG. 15 is another partial perspective view of the safety plug in FIG. 1 when being plugged in by two blades of a power plug.

With reference to FIGS. 11 to 15, when the force exerted on the plug 100 is released and the inner housing 10 is not compressed, the inner housing 10 automatically bounces upwardly with the elastic force of the resilient members 16 and the locating link 44 is driven to rotate 45° clockwise. Because the pawl 32 engages one of the teeth 313 of the ratchet 31, the ratchet wheel 31 can be kept from being rotated clockwise. Accordingly, the conducting rods 52 fitted in the bottom arced cavities 311 of the ratchet wheel 31 and the cover 41 fitted by the conducting rods 52 are kept from being rotated as well. The disk 42 securely connected with the cover 41 is also kept from being rotated but is moved upwardly in the inner housing 10. When the disk 42 is moved upwardly, the locating protrusion 441 of the locating link 44 disengages from the locating recess of the disk 42. Meanwhile, the resilient element 45 pushes the locating link 44 to abut against the disk 42 so that the locating link 44 is not away from the disk 42. When the disk 42 is moving upwardly, the disengaged locating protrusion 441 of the locating link 44 is further rotated to engage another locating recess 421. With further reference to FIG. 12, with each one of the two blades 101 being held between a corresponding fence 14 and a corresponding conducting rod 52, the plug 100 is firmly plugged into the safety socket.

Figure 16:
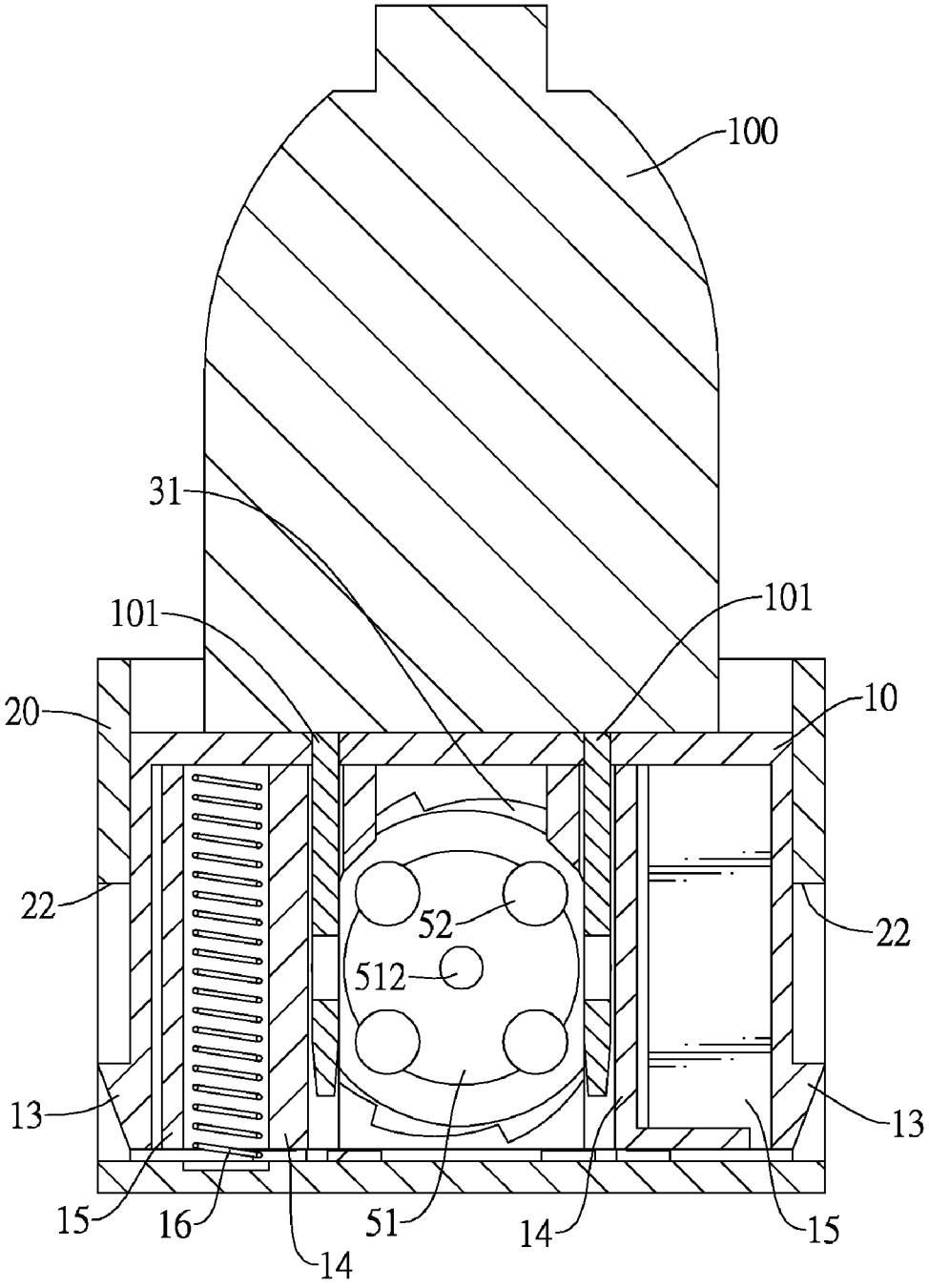
FIG. 16 is another top view in partial section of the safety socket in FIG. 1 when being plugged in a power plug.

With reference to FIG. 16, to unplug the plug 100 from the safety socket, the inner housing 10 is pushed inwardly again so that the locating link 44 of the driving assembly 40 of the conducting unit 3 is rotated 45° counterclockwise and the electrical connection assembly 50 is also rotated 45° counterclockwise. As a result of the rotation, each one of the two blades 101 is no longer held between the corresponding fence 14 and the corresponding conducting rod 52. Hence, the two conducting rods 52 are respectively disconnected from the blades 101, and the plug 100 can be easily unplugged from the safety socket.

Figure 17:
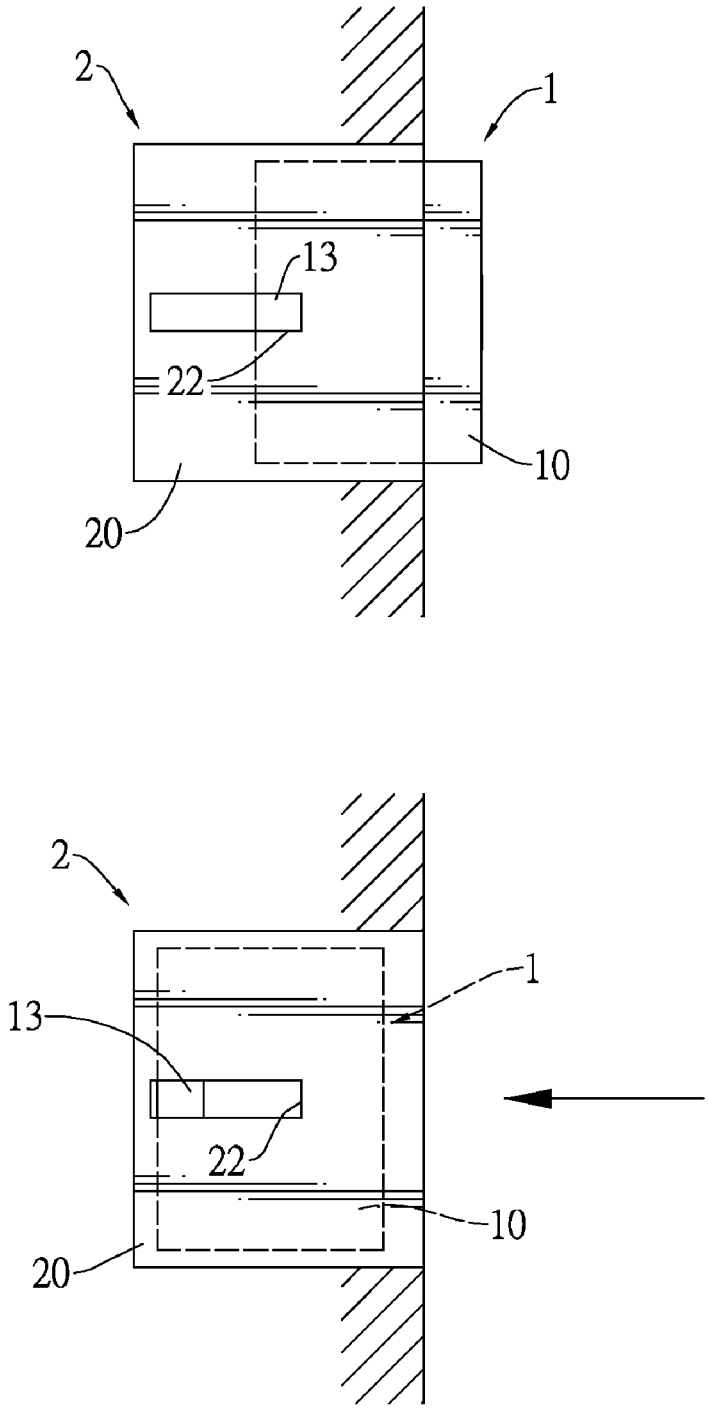
FIG. 17 is an operational side view in partial section of the safety socket in FIG. 1 mounted in a wall.
Figure 18:
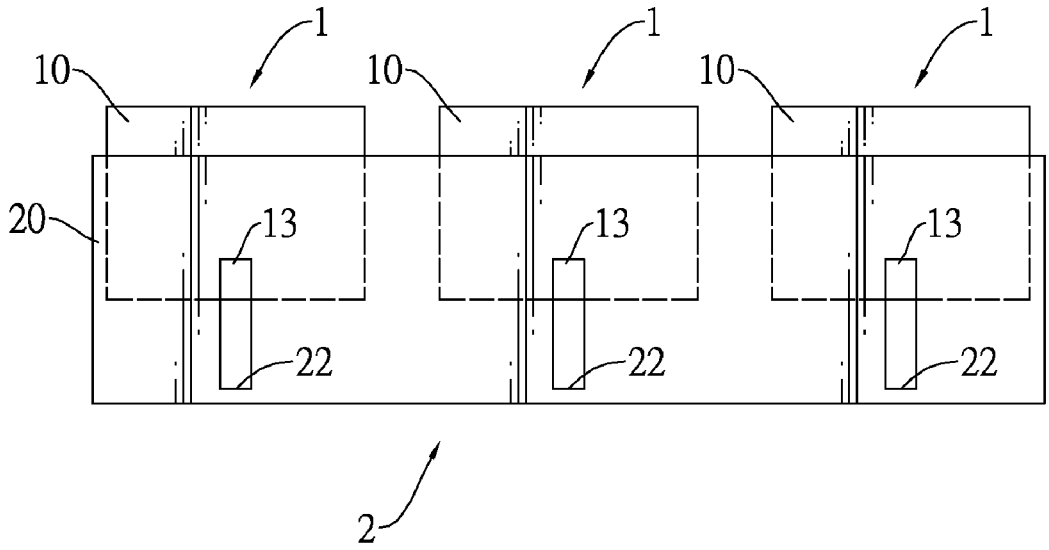
FIG. 18 is a side view of a second embodiment of a safety socket in accordance with the present invention.

With reference to FIG. 17, the safety socket can be mounted inside a wall. The base 2 is inserted into the wall and the opening thereof faces outwardly. The insertion block 1 is mounted through the opening of the base 2 and can be pushed inwardly into the wall. With reference to FIG. 18, a second embodiment of a safety socket in accordance with the present invention has a plurality of insertion blocks 1 and a base 2. The base 2 has an outer housing 20 having a plurality of slots 22 formed through at least one wall thereof for the protrusions 13 of the insertion blocks 1 to be mounted in the corresponding slots 22 so that the insertion blocks 1 are covered by the outer housing 20. Accordingly, the safety socket of the present invention is not only anti-loose, easy-unplugging but also expandable in terms of the number of the insertion blocks 1 based on the customized demand.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A safety socket comprising:

at least one insertion block, each one of the at least one insertion block having:

an inner housing being hollow and having:

a bottom wall;

a front wall;

two sidewalls;

an opening formed through the bottom wall;

two insertion holes formed through the front wall; and at least one protrusion, each one of the at least one protrusion formed on and protruding from an outside surface of one of the sidewalls of the inner housing adjacent to the front wall; and two support frames securely mounted in the inner housing, and each support frame having a fence securely mounted in the inner housing;

a base having:

an outer housing being hollow, covered on the at least one insertion block and having:

a top wall;

a rear wall;

two sidewalls;

an opening formed through a top wall of the outer housing and facing the opening of each one of the at least one inner housing; and at least one slot, each one of the at least one slot formed through one of the sidewalls of the outer housing to receive a corresponding protrusion; and at least one pair of guide arms, each pair of the guide arms securely mounted on an inside surface of the rear wall of the outer housing to respectively guide the two support frames on a corresponding insertion block;

at least one conducting unit, each one of the at least one conducting unit mounted between the two support frames of a corresponding insertion block and having:

a ratchet wheel having:

a center hole formed through the ratchet wheel; and multiple teeth formed around the ratchet wheel;

a pawl, one end of the pawl connected to an inside surface of the front wall of a corresponding inner housing, and the other end abutting against one of the teeth of the ratchet wheel;

a driving assembly having:

a disk having:

multiple locating recesses circumferentially formed in a bottom of the disk; and a center hole formed through the disk;

a support arm, one end of the support arm securely mounted on the inside surface of the rear wall of the outer housing; and a locating link pivotally mounted on the other end of the support arm and having:

a locating protrusion selectively engaging one of the locating recesses of the disk; and a center hole formed through the locating link;

an electrical connection assembly mounted between the ratchet wheel and the driving assembly and having:

a carrier taking a form of a solid cylinder, mounted between a corresponding pair of guide arms of the base, and having:

multiple longitudinal grooves formed in the carrier; and a spindle formed through the carrier and respectively mounted through the center holes of the ratchet wheel, the disk and the locating link; and multiple conducting rods mounted respectively in the longitudinal grooves, wherein two ends of each conducting rod are securely and respectively connected with the ratchet wheel and the disk.

2. The safety socket as claimed in claim 1, wherein the driving assembly of each one of the at least one conducting unit further has a cover, the cover is securely mounted on a top of the disk and has:

a top recess formed in a top of the cover; and multiple top arced grooves formed in a wall of the top recess and each one of the top arced grooves fitted in by one end of a corresponding conducting rod.

3. The safety socket as claimed in claim 2, wherein the ratchet wheel of each one of the at least one conducting unit further has:

a bottom recess formed in a bottom of the ratchet wheel; and multiple bottom arced grooves formed in a wall of the bottom recess and each one of the bottom arced grooves fitted in by one end of a corresponding conducting rod.

4. The safety socket as claimed in claim 3, wherein the cover of each one of the at least one conducting unit has four top arced grooves; the ratchet of each one of the at least one conducting unit has four bottom arced grooves; the electrical connection assembly of each one of the at least one conducting unit has four conducting rods, and the carrier of each one of the at least one conducting unit has four longitudinal grooves.

5. The safety socket as claimed in claim 1, wherein the disk of each one of the at least one conducting unit has eight locating recesses, and an angle included between adjacent locating recesses is 45°.

6. The safety socket as claimed in claim 2, wherein the cover of each one of the at least one conducting unit further has a center hole through which the spindle of the carrier is mounted.

7. The safety socket as claimed in claim 1, wherein the driving assembly of each one of the at least one conducting unit further has a resilient element mounted around one end of the spindle of the carrier and compressing a bottom of the locating link to abut against the disk.

8. The safety socket as claimed in claim 1, wherein each support frame of each one of the at least one insertion block has:

a cylinder formed on a side of the fence of the support frame, having a hole formed through the cylinder, one end of the cylinder securely mounted on the inside surface of the front wall of a corresponding inner housing; and a resilient member received in the hole of the cylinder.

9. The safety socket as claimed in claim 1, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

10. The safety socket as claimed in claim 2, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

11. The safety socket as claimed in claim 3, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

12. The safety socket as claimed in claim 4, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

13. The safety socket as claimed in claim 5, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

14. The safety socket as claimed in claim 6, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

15. The safety socket as claimed in claim 7, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

16. The safety socket as claimed in claim 8, wherein the safety socket has a plurality of insertion blocks, and the outer housing has a plurality of slots formed through at least one wall of the outer housing for the protrusions of the insertion blocks to be respectively mounted in the slots so that the insertion blocks are covered by the outer housing.

* * * * *